US008682188B2

(12) United States Patent
Eom

(10) Patent No.: US 8,682,188 B2
(45) Date of Patent: Mar. 25, 2014

(54) IMAGE FORMING APPARATUS WITH DEVELOPING UNITS HAVING DIFFERENT VOLTAGE LEVELS

(75) Inventor: Yoon Seop Eom, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 643 days.

(21) Appl. No.: 12/926,079

(22) Filed: Oct. 25, 2010

(65) Prior Publication Data

US 2011/0097097 A1 Apr. 28, 2011

(30) Foreign Application Priority Data

Oct. 26, 2009 (KR) ..... 10-2009-0101548
Aug. 31, 2010 (KR) ..... 10-2010-0084496

(51) Int. Cl.
*G03G 15/06* (2006.01)

(52) U.S. Cl.
USPC ..... 399/55; 399/88; 399/228

(58) Field of Classification Search
USPC ..... 399/53, 55, 88, 226, 228
See application file for complete search history.

(56) References Cited

U.S. PATENT DOCUMENTS 5,376,998 A 12/1994 Suzuki
5,627,722 A 5/1997 Hirst
7,020,409 B2 * 3/2006 Kim ..... 399/88
2002/0067929 A1 6/2002 James et al.
2003/0112297 A1 * 6/2003 Hiratsuka et al.
2004/0005165 A1 1/2004 Yoon et al.
2004/0067078 A1 4/2004 An et al.
2004/0075346 A1 4/2004 Kim
2004/0175197 A1 9/2004 Kyung

FOREIGN PATENT DOCUMENTS

CN 1487376 A 4/2004
JP H0865893 A 3/1996
KR 20040032261 4/2004

OTHER PUBLICATIONS

Chinese Office Action of Oct. 21, 2013 in related Chinese Patent Application 201010519627.X.

* cited by examiner

*Primary Examiner* — David Gray
*Assistant Examiner* — Laura Roth
(74) *Attorney, Agent, or Firm* — Staas & Halsey LLP

(57) ABSTRACT

An image forming apparatus is provided. The image forming apparatus includes a source, voltage generator to generate a source voltage to provide developing units with a power-supply voltage, a second voltage generator to generate a developing bias voltage applied to a developing roller and a supply bias voltage applied to a supply roller upon receiving the source voltage generated by the source voltage generator, and a switching unit to selectively provide the developing units with different voltage levels generated by the second voltage generator. The apparatus includes a Zener diode installed at a common end, so that a deviation of the developing voltage applied to the developing device affected by a deviation of Zener diode components can be reduced, resulting in an increased color image quality and a reduction in production costs.

18 Claims, 5 Drawing Sheets

IMAGE FORMING APPARATUS WITH DEVELOPING UNITS HAVING DIFFERENT VOLTAGE LEVELS

CROSS-REFERENCE TO RELATED APPLICATIONS

This application claims the priority benefit of Korean Patent Applications Nos. 2009-0101548 filed on 26 Oct. 2009 and 2010-0084496 filed on 31 Aug. 2010 in the Korean Intellectual Property Office, the disclosures of which are incorporated herein by reference.

BACKGROUND

1. Field

At least one embodiment relates to an image forming apparatus including a plurality of developing devices that use the electrophotographic scheme.

2. Description of the Related Art

Generally, an electrophotographic printer forms an electrostatic latent image by scanning light onto a photoconductive drum charged with a predetermined potential, develops the electrostatic latent image with toners of predetermined colors, and transfers and fixes the developed image onto a sheet of paper, such that a color image is formed.

In order to print a full-color image, the colors yellow (Y), magenta (M), cyan (C), and black (K) are required for the image forming apparatus. Thus, four developing devices are required to fix toners of four colors onto an electrostatic latent image.

A high voltage (e.g., hundreds of volts or thousands of volts), such as a developing bias voltage applied to the developing roller so as to fix the toner of the developing roller to a photoconductive drum or a supply bias voltage applied to the supply roller so as to provide the toner to a developing roller, is applied to each developing device.

A color image-forming scheme is classified into a multi-pass scheme and a single-pass scheme. The multi-pass scheme forms a color image by rotating one photoconductive drum several times. The single-pass scheme forms a color image by rotating each of the photoconductive drums only once.

In the case of the image forming apparatus based on the multi-pass scheme, four developing devices are sequentially operated, so that a high voltage is also sequentially applied to the four developing devices. In this case, a predetermined voltage is applied to a developing roller of each developing device and a supply roller in such a manner that a predetermined potential difference is formed between the developing roller and the supply roller.

In order to form a difference in potential between the developing bias voltage and the supply bias voltage, each developing device uses Zener diode components.

However, these Zener diode components are generally installed at the last end serving as an output side that provides the developing roller and the supply roller of each developing device, so that it is impossible to adjust a deviation of components related to the zener voltage of the Zener diode.

For example, if the source voltage provided to each developing device is adjusted to provide a voltage (in which a deviation of components of the Zener diode corresponding to the yellow (Y) developing device is considered) to a yellow (Y) developing device, a deviation of several tens of volts occurs in voltage applied to other developing devices, so that it is difficult for each developing device to control a developing voltage level at a desired voltage level. In other words, due to a deviation of Zener diode components that form a difference in potential between the developing bias voltage and the supply bias voltage, it is difficult for individual developing devices to acquire their desired color images, resulting in a deterioration of the color image quality.

SUMMARY

Therefore, it is an aspect of at least one embodiment to provide an image forming apparatus which changes an installation position of a Zener diode that forms a difference in potential between the developing bias voltage and the supply bias voltage of each developing unit to improve a color image quality, thereby reducing respective developing units' developing voltage deviation caused by a deviation of Zener diode components.

Additional aspects of the at least one embodiment will be set forth in part in the description which follows and, in part, will be obvious from the description, or may be learned by practice of the invention.

The foregoing and/or other aspects are achieved by providing an image forming apparatus having a plurality of developing units including a developing roller and a supply roller, including a first, source, voltage generator to generate a source voltage so as to provide the plurality of developing units with a power-supply voltage, a second voltage generator to generate a developing bias voltage applied to the developing roller and a supply bias voltage applied to the supply roller upon receiving the source voltage generated by the source voltage generator, and a switching unit to selectively provide the plurality of developing units with different voltage levels generated by the second voltage generator.

The switching unit may include a single pair of switching elements in each developing unit, and the single pair of switching elements may include a first switching element connected to a developing bias end of the developing roller and a second switching element connected to a supply bias end of the supply roller.

The voltage generator may include a first Zener diode which is connected in series to an output end of the source voltage generator and a first switching element of the switching unit, and a second Zener diode which is connected in series to an output end of the source voltage generator and a second switching element of the switching unit, wherein the first Zener diode and the second Zener diode are arranged in opposite directions.

The number of first Zener diodes may be 1, and the number of second Zener diodes may be 1.

The source voltage generator may generate a source voltage in which a DC voltage and an AC voltage are overlapped with each other.

The source voltage generator may generate the source voltage by overlapping the AC voltage, where a deviation of components of the voltage generator is compensated, with the DC voltage.

The source voltage generator may generate the source voltage by overlapping the DC voltage, where a deviation of components of the voltage generator is compensated, with the AC voltage.

The source voltage generator may generate the source voltage composed of only a DC voltage.

The apparatus may further include a first contamination prevention unit including at least one resistor, to connect the at least one resistor to a front end of the switching unit, the first contamination prevention unit being grounded through the resistor such that the first contamination prevention unit is operated as a load of the developing unit not performing the developing action, in order to prevent inter-color contamination by which a toner moves to a specific developing unit not performing a developing action from among the developing units.

The apparatus may further include a second contamination prevention unit which provides a DC voltage to a developing bias end of a specific developing unit not performing the developing action and a supply bias end so as to prevent inter-color contamination by which a toner moves to the specific developing unit not performing developing action from among the developing units.

The foregoing and/or other aspects are achieved by providing an image forming apparatus, including a single photoconductive drum, a light scanning unit to form an electrostatic latent image by scanning a light beam to the photoconductive drum, a plurality of developing units arranged in a rotation direction of the photoconductive drum so as to provide a toner to the electrostatic latent image formed on the photoconductive drum, the developing units each including a developing roller and a supply roller, a first, source, voltage generator to generate a source voltage so as to provide a power-supply signal to the developing units, a second voltage generator to generate a developing bias voltage applied to the developing roller and a supply bias voltage applied to the supply roller upon receiving the source voltage generated by the source voltage generator, and a switching unit to selectively provide the plurality of developing units with different voltage levels generated by the voltage generator.

The switching unit may include a single pair of switching elements in each developing unit, and the single pair of switching elements may include a first switching element connected to a developing bias end of the developing roller and a second switching element connected to a supply bias end of the supply roller.

The voltage generator may include a first Zener diode which is connected in series to an output end of the source voltage generator and a first switching element of the switching unit, and a second Zener diode which is connected in series to an output end of the source voltage generator and a second switching element of the switching unit, wherein the first Zener diode and the second Zener diode are arranged in opposite directions.

The number of first Zener diodes may be 1, and the number of second Zener diodes may be 1.

The source voltage generator may generate a source voltage in which a DC voltage and an AC voltage are overlapped with each other or another source voltage composed of only a DC voltage.

The apparatus may further include a first contamination prevention unit including at least one resistor, to connect the at least one resistor to a front end of the switching unit, the first contamination prevention unit being grounded through the resistor such that the first contamination prevention unit is operated as a load of the developing unit not performing the developing action, in order to prevent inter-color contamination by which a toner moves to a specific developing unit not performing a developing action from among the developing units.

The foregoing and/or other aspects are achieved by providing an image forming apparatus, including: a plurality of developing units each including a developing roller and a supply roller; a first, source, voltage generator to generate a source voltage to provide the plurality of developing units with a power-supply voltage; a second voltage generator to generate a developing bias voltage applied to the developing roller and a supply bias voltage applied to the supply roller upon receiving the source voltage generated by the source voltage generator; and a switching unit to selectively provide the plurality of developing units with different voltage levels, wherein the second voltage generator separates a developing bias end and a supply bias end of each of the developing units at a front end of the switching unit.

The voltage generator may further include a first Zener diode connected in series to an output end of the source voltage generator and a first switching element of the switching unit; and a second Zener diode connected in series to an output end of the source voltage generator and a second switching element of the switching unit, wherein the first Zener diode and the second Zener diode are arranged in opposite directions.

The switching unit may include a plurality of first and second switching elements, and the image forming apparatus may further include a first contamination prevention unit connected to a line via which a terminal acting as one terminal of each of the second switching elements is connected to one side of the second Zener diode, and a second contamination prevention unit connected to a line via which a terminal acting as a terminal of each of the first switching elements is connected to a terminal acting as another terminal of each of the second switching elements.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
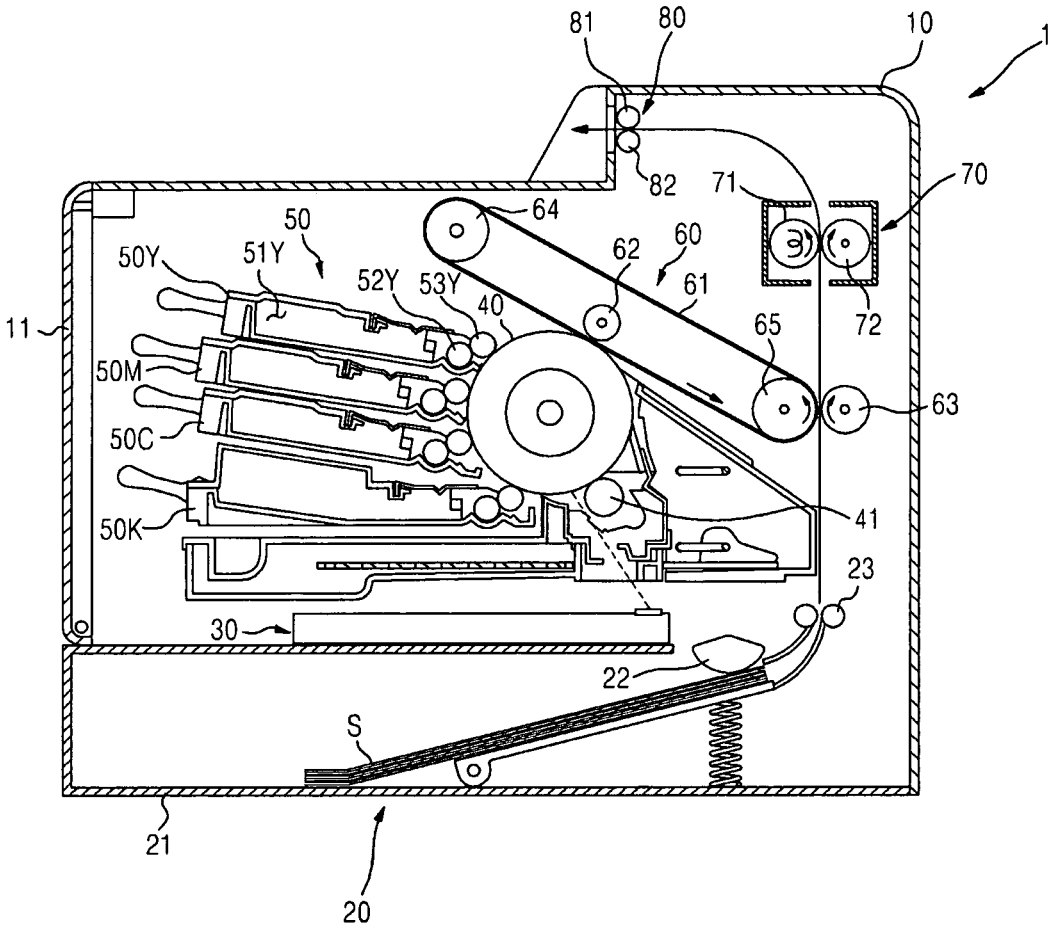
FIG. 1 is a structural diagram illustrating an image forming apparatus according to at least one exemplary embodiment.

Reference will now be made in detail to at least one embodiment, examples of which are illustrated in the accompanying drawings, wherein like reference numerals refer to like elements throughout.

FIG. 1 is a structural diagram illustrating an image forming apparatus according to at least one exemplary embodiment.

Referring to FIG. 1, the image forming apparatus 1 according to the at least one exemplary embodiment includes a main body 10, a printing medium feeder 20, a light scanning unit 30, a photoconductive drum 40, a developing device 50, a transfer unit 60, a fixing unit 70, and a printing medium discharger 80.

The main body 10 forms the external appearance of the image forming apparatus 1, and supports a variety of components installed in the image forming apparatus. A main body cover 11 is rotatably installed at one end of the main body 10. The cover 11 opens or closes some parts of the main body 10.

The printing medium feeder 20 feeds a printing medium to the transfer unit 60. The printing medium feeder 20 includes a cassette 21, a pickup roller 22, and a transfer roller 23. The cassette 21 stores a printing medium S therein. The pickup roller 22 picks up the printing medium S seated in the cassette 21 individually. The transfer roller 23 then moves the picked-up printing medium to the transfer unit 60.

The light scanning unit 30 is located at the bottom of the developing device 50, although is not limited thereto, and scans light corresponding to image information onto the photoconductive drum 40, so that an electrostatic latent image is formed on the photoconductive drum 40.

The photoconductive drum 40 is formed by a photoconductive layer formed on a circumference of a cylindrical metal drum. The photoconductive drum 40 is used as an image carrier to carry the electrostatic latent image formed by the light scanning unit 30 and a toner image formed by the developing device 50. The photoconductive drum 40 may be rotatably connected to the main body 10.

A charge roller 41 is installed in the main body 10. The charge roller 41 charges the photoconductive drum 40 with a predetermined potential before light is scanned from the light scanning unit 30. The charge roller is an example of a charger that charges the photoconductive drum 40 with a uniform electric potential. The charge roller 41 rotates while contacting the circumference of the photoconductive drum 40 or rotates while not contacting the circumference of the photoconductive drum 40, and provides the photoconductive drum 40 with electric charges, so that the circumference of the photoconductive drum 40 is charged with a uniform electric charge. If required, a corona discharger (not shown) may be used instead of the charge roller 41.

The developing device 50 provides a toner to the photoconductive drum 40 onto which the electrostatic latent image is formed, so that a toner image is formed. The developing device 50 includes four developers 50Y, 50M, 50C, and 50K respectively including toners of different colors, for example, yellow (Y), magenta (M), cyan (C) and black (K).

Individual developers 50Y, 50M, 50C, and 50K each include toner cartridges (e.g., 51Y), supply rollers 52Y, 52M, 52C, and 52K (see FIG. 3), and developing rollers 53Y, 53M, 53C, and 53K (see FIG. 3), respectively.

Each of the toner cartridges 51Y, 51M, 51C, and 51K stores a toner to be provided to the photoconductive drum 40.

The supply rollers 52Y, 52M, 52C, and 52K provide the toners stored in the toner cartridges 51Y, 51M, 51C, and 51K to the developing rollers 53Y, 53M, 53C, and 53K, respectively. A supply bias voltage to provide the toners stored in the toner cartridges 51Y, 51M, 51C, and 51K to the developing rollers 53Y, 53M, 53C, and 53K is applied to the supply rollers 52Y, 52M, 52C, and 52K.

The developing rollers 53Y, 53M, 53C, and 53K fix the toner on the surface of the photoconductive drum 40 onto which the electrostatic latent image is formed, so that the toner image is formed. A developing bias voltage, that develops the toner received from the supply rollers 52Y, 52M, 52C, and 52K on the electrostatic latent image formed on the photoconductive drum 40, is applied to the developing rollers 53Y, 53M, 53C, and 53K.

The transfer unit 60 includes an intermediate transfer belt 61, a first transfer roller 62, and a second transfer roller 63.

The intermediate transfer belt 61 is an image carrier to carry the toner image formed by the developing device 50. The intermediate transfer belt 61 is supported by supporting rollers 64 and 65, and travels at the same linear velocity as the photoconductive drum 40. The length of the intermediate transfer belt 61 is equal to or greater than the length of the maximum printing medium size that can be used with the image forming apparatus.

The first transfer roller 62 is arranged to face the photoconductive drum 40 through the intermediate transfer belt 61 interposed therebetween, so that the toner image formed on the photoconductive drum 40 is transferred to the intermediate transfer belt 61. A first transfer bias voltage to transfer the toner image formed on the photoconductive drum 40 to the intermediate transfer belt 61 is applied to the first transfer roller 62.

The second transfer roller 63 is arranged to face the supporting roller 65 through the intermediate transfer belt 61 interposed therebetween. The second transfer roller 63 is spaced apart from the intermediate transfer belt 61 while the toner image is transferred from the photoconductive drum 40 to the intermediate transfer belt 61. If the image formed on the photoconductive drum 40 is completely transferred to the intermediate transfer belt 61, the second transfer roller 63 contacts the intermediate transfer belt 61 with a predetermined pressure. The image on the intermediate transfer belt 61 is transferred to the printing medium (e.g., paper) when the second transfer roller 63 contacts the intermediate transfer belt 61. A second transfer bias voltage to transfer the toner image to the printing medium is applied to the second transfer roller 63.

The fixing unit 70 includes a heating roller 71 having a heating source and a pressure roller 72 installed to face the heating roller 71. When the printing medium passes between the heating roller 71 and the pressure roller 72, an image is fixed to the printing medium by heat transmitted from the heating roller 71 and by pressure acting between the heating roller 71 and the pressure roller 72.

The printing medium discharger 80 includes a discharge roller 81 and a discharge backup roller 82, and discharges the printing medium passing through the fixing unit 70 to the exterior of the main body 10.

Operations of the above-mentioned image forming apparatus will hereinafter be described in detail.

When the printing action begins, the surface of the photoconductive drum 40 is uniformly charged by the charge roller 41. A light beam, which may have any given wavelength, is illuminated from the light scanning unit 30 to the surface of the uniformly-charged photoconductive drum 40. For example, a light beam corresponding to yellow (Y)-color image information is illuminated on the photoconductive drum 40.

An electrostatic latent image corresponding to the Y-color image is formed on the photoconductive drum 40.

Subsequently, the developing bias is applied to the developing roller 53 of the yellow (Y)-developer 50Y, such that a Y-color toner is attached to the electrostatic latent image, and therefore a Y-color toner image is formed on the photoconductive drum 40. Such a toner image is transferred to the intermediate transfer belt 61 by the first transfer roller 62.

If the Y-color image is transferred to a sheet of paper, the light scanning unit 30 scans a light beam corresponding to image information of another color (e.g., M-color) on the photoconductive drum 40, such that the electrostatic latent image corresponding to the M-color image is formed. The M-color developer 50M provides M-color toner to the electrostatic latent image, so as to form a toner image. The M-color toner image formed on the photoconductive drum 40 is transferred to the intermediate transfer belt 61 by the first transfer roller 62. The M-color toner image is overlapped with the Y-color toner image having already been transferred.

If the above-mentioned operations are performed on the cyan (C) and black (K) colors, a color image in which Y-, M-, C-, and K-color images are overlapped is completed on the intermediate transfer belt 61. The completed color image is transferred to the printing medium that passes between the intermediate transfer belt 61 and the second transfer roller 63. The printing medium is discharged to the exterior of the main body 10 after passing through the fusing unit 70 and the printing medium discharger 80.

Figure 2:
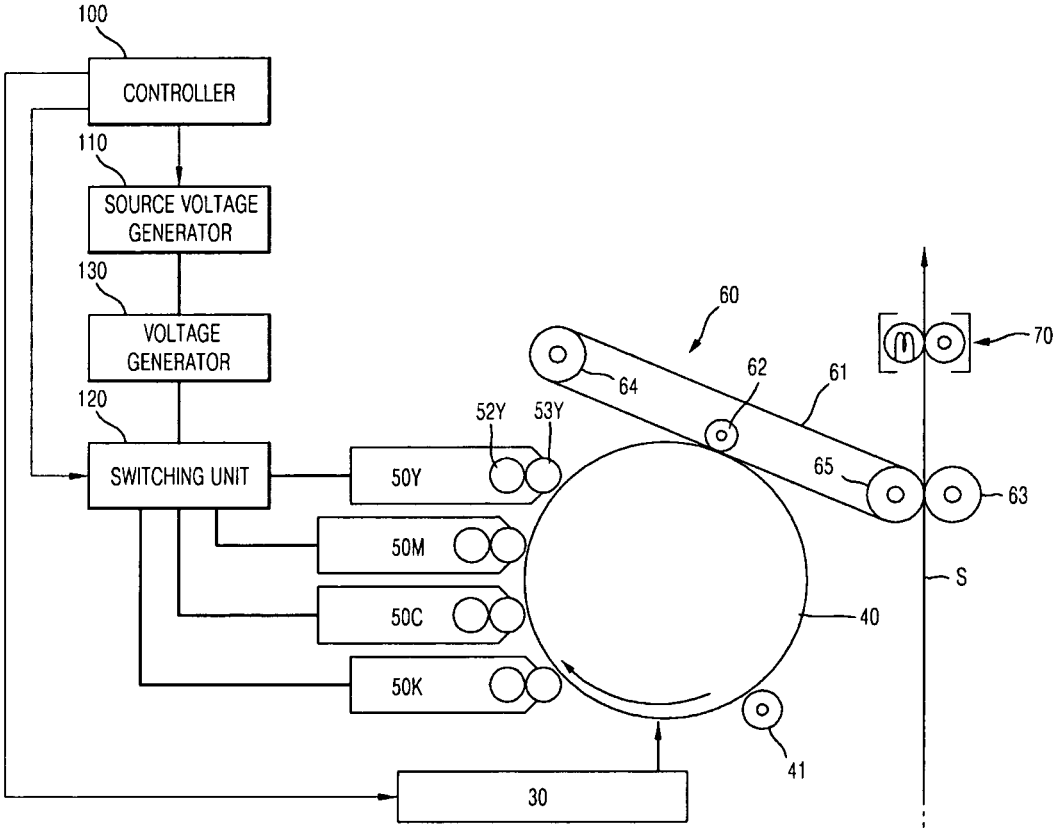
FIG. 2 is a control block diagram illustrating an image forming apparatus according to at least one exemplary embodiment.

FIG. 2 is a control block diagram illustrating an image forming apparatus according to at least one embodiment.

Referring to FIG. 2, a developing bias voltage to fix a toner onto the photoconductive drum 40 is applied to the developing rollers 53Y, 53M, 53C, and 53K of individual developers 50Y, 50M, 50C and 50K. A supply bias voltage to provide a toner to the developing rollers 53Y, 53M, 53C and 53K is applied to the supply rollers 52Y, 52M, 52C, and 52K.

The developing bias voltage or the supply bias voltage may be a DC voltage or a combination of a DC voltage and an AC voltage. The developing bias voltage or the supply bias voltage may be a high voltage (e.g., hundreds of volts or thousands of volts).

In the image forming apparatus according to at least one embodiment, individual developers 50Y, 50M, 50C and 50K are sequentially operated. The developing bias voltage is applied to the developing roller 53Y of the selected developer (e.g., 50Y), and no developing bias voltage is applied to the developing rollers 53M, 53C and 53K of the remaining developers (e.g., 50M, 50C and 50K). In addition, the supply bias voltage is applied only to the supply roller 52Y of the selected developer (e.g., 50Y) in the same manner as in the developing bias voltage, and no supply bias voltage is applied to the supply rollers 52M, 52C and 52K of the remaining developers (e.g., 50M, 50C and 50K).

Likewise, in order to selectively provide a high bias voltage to individual developers 50Y, 50M, 50C and 50K, the image forming apparatus according to at least one embodiment includes a controller 100, a source voltage generator 110, a voltage generator 130, and a switching unit 120.

The controller 100 controls operations of the source voltage generator 110 and the switching unit 120, such that the developing bias voltage and the supply bias voltage are sequentially applied to each developer 50Y, 50M, 50C or 50K. In addition, the controller 100 controls operations of the light scanning unit 30.

The source voltage generator 110 generates a source voltage, such that the developing bias voltage to fix a toner to the photoconductive drum 40 is applied to the developing rollers 53Y, etc. of the developers 50Y, 50M, 50C and 50K, and the supply bias voltage to provide a toner to the developing rollers 53Y, etc. is applied to the supply rollers 52Y, 52M, 52C and 52K.

The voltage generator 130 generates the developing bias voltage and the supply bias voltage at different voltage levels from the source voltage generated by the source voltage generator 110. In other words, the voltage generator 130 generates the developing bias voltage and the supply bias voltage having a difference in potential therebetween, upon receiving the source voltage generated by the source voltage generator 110.

The switching unit 120 selectively provides the developing bias voltage generated by the voltage generator 130 to the developing rollers 53Y, 53M, 53C and 53K of the developers 50Y, 50M, 50C and 50K, and at the same time selectively provides the supply bias voltage generated by the voltage generator 130 to the supply rollers 52Y, 52M, 52C and 52K.

Figure 3:
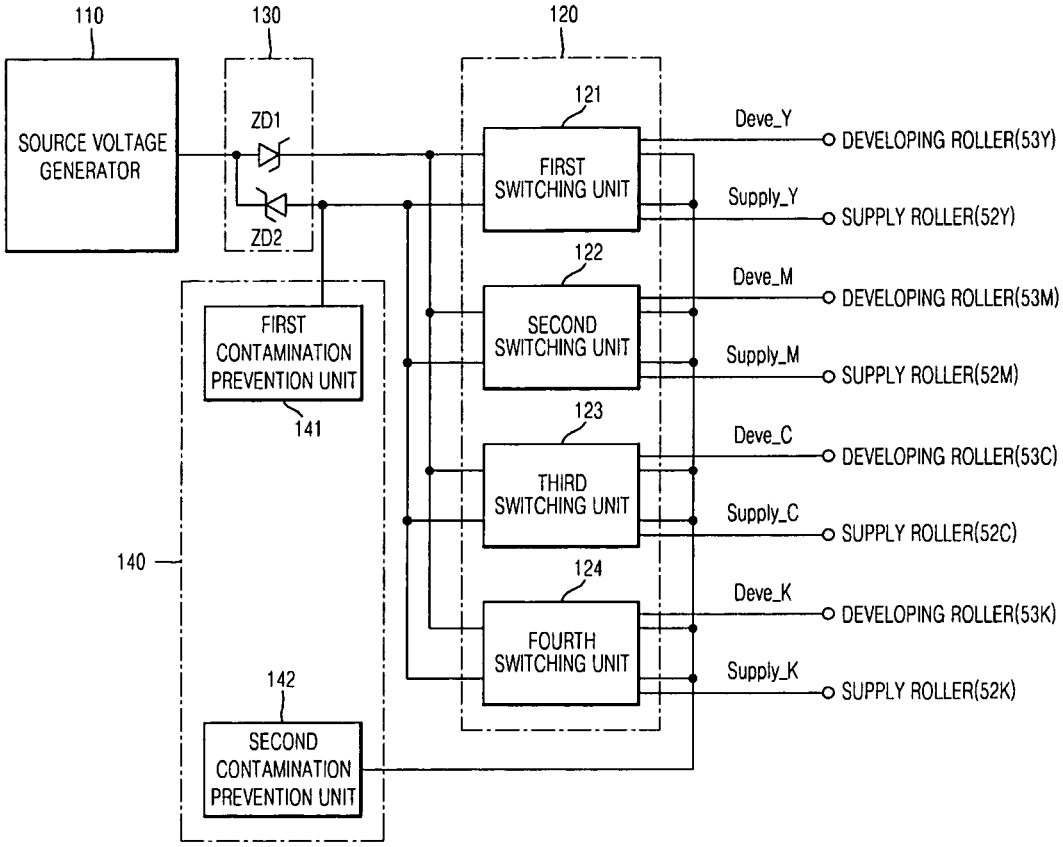
FIG. 3 is a conceptual diagram illustrating a method of reducing a deviation of voltage applied to several developing units in an image forming apparatus according to at least one exemplary embodiment.
Figure 4:
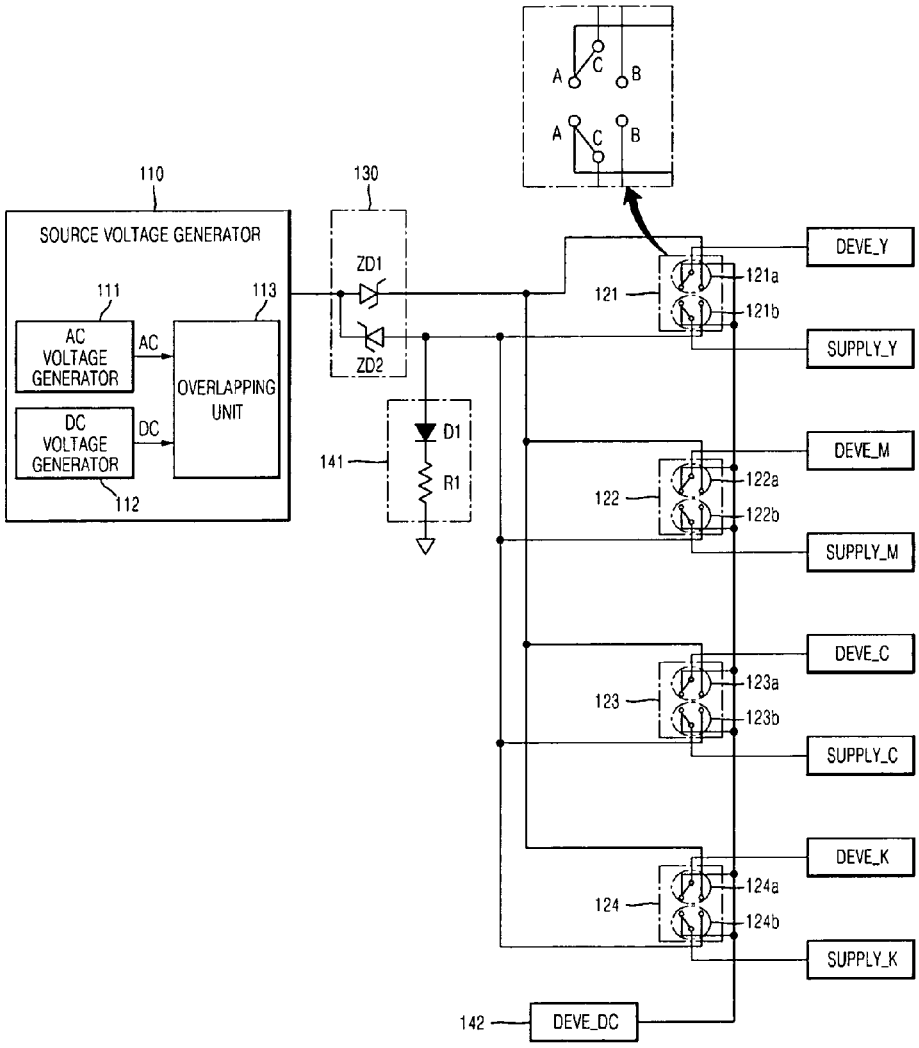
FIG. 4 is a detailed block diagram illustrating individual constituent elements shown in FIG. 3 according to at least one exemplary embodiment.

FIG. 3 is a conceptual diagram illustrating a method of reducing a deviation of voltage applied to several developing units in an image forming apparatus according to at least one exemplary embodiment. FIG. 4 is a detailed block diagram illustrating the source voltage generator 110, the switching unit 120, the voltage generator 130, and the contamination prevention unit 140 shown in FIG. 3 according to at least one exemplary embodiment.

Referring to FIGS. 3 and 4, a switching unit 120 including first to fourth switching units 121~124 is installed between the source voltage generator 110 and each developer 50Y, 50M, 50C or 50K. For example, the first to fourth switching units 121 to 124 include a pair of switching elements (121*a*, 121*b*), a pair of switching elements (122*a*, 122*b*), a pair of switching elements (123*a*, 123*b*), and a pair of switching elements (124*a*, 124*b*), respectively. The first switching elements 121*a*, 122*a*, 123*a*, and 124*a* switch the developing bias voltage provided to the developing rollers 53Y, 53M, 53C and 53K. The second switching elements 121*b*, 122*b*, 123*b*, and 124*b* switch the supply bias voltage provided to the supply rollers 52Y, 52M, 52C and 52K.

One voltage generator 130 composed of two Zener diodes ZD1 and ZD2 arranged in opposite directions is arranged between the source voltage generator 110 and the switching unit 120. The voltage generator 130 is adapted to generate the developing bias voltage and the supply bias voltage that have a potential difference therebetween from the source voltage generated from the source voltage generator 110. In this case, if the first Zener diode ZD1 is forward connected to the source voltage, the first Zener diode ZD1 generates and outputs the source voltage generated by the source voltage generator 110 without any change. Otherwise, if the first Zener diode ZD1 is inversely connected to the source voltage, the source voltage is clamped as high as a first Zener voltage of the first Zener diode ZD1, and the clamped result voltage is output from the first Zener diode ZD1.

Meanwhile, if the second Zener diode ZD2 inversely connected to the first Zener diode ZD1 is forward connected to the source voltage, the second Zener diode ZD2 generates and outputs the source voltage generated by the source voltage generator 110. Otherwise, if the second Zener diode ZD2 is inversely connected to the source voltage, the source voltage is clamped as high as a second Zener voltage of the second Zener diode ZD2, and the clamped result voltage is output from the second Zener diode ZD2. Therefore, the voltage generator 130 generates the developing bias voltage and the supply bias voltage that have a difference in potential upon receiving the source voltage.

For reference, the voltage generator 130 generates the developing bias voltage and the supply bias voltage having a difference in potential therebetween from the source voltage generated by the source voltage generator 110, and can also generate a voltage provided to a cleaning blade to scrape a residual toner off the surface of the photoconductive drum 40.

The first Zener diode ZD1 of the voltage generator 130 is forward connected to the output end of the source voltage generator 110 and the first switching elements 121*a*, 122*a*, 123*a*, and 124*a* of the switching unit 120. The second Zener diode ZD2 is inversely connected to the output end of the source voltage generator 110 and the second switching elements 121*b*, 122*b*, 123*b*, and 124*b* of the switching unit 120. The first Zener diode ZD1 and the second Zener diode ZD2 are arranged in opposite directions so that a predetermined potential difference is formed between the developing bias voltage and the supply bias voltage.

Each of the first switching elements 121*a*, 122*a*, 123*a*, and 124*a* of the switching unit 120 includes three contact points A, B and C. Each of the second switching elements 121*b*, 122*b*, 123*b*, and 124*b* includes three contact points A, B and C.

A common contact point C of each first switching element 121*a*, 122*a*, 123*a* or 124*a* is connected to the developing bias terminal (e.g., Deve_Y of the Y-color developer) of the developing roller of the corresponding developer. A common contact point C of each second switching element 121*b*, 122*b*, 123*b*, or 124*b* is connected to the feeding bias terminal (e.g., Supply_Y of the Y-color developer) of the supply roller of the corresponding developer.

A terminal B, acting as one terminal of each first switching element 121*a*, 122*a*, 123*a* or 124*a*, is connected to one side of the first Zener diode ZD1. A terminal B, acting as one terminal of each second switching element 121*b*, 122*b*, 123*b* or 124*b*, is connected to one side of the second Zener diode ZD2. In this case, a first contamination prevention unit 141 is connected to a line via which the terminal B, acting as one terminal of the second switching element 121*b*, 122*b*, 123*b* or 124*b*, is connected to one terminal of the second Zener diode ZD2.

The terminal A, acting as the other terminal of each first switching element 121*a*, 122*a*, 123*a* or 124*a*, is connected to the terminal A, acting as the other terminal of each second switching element 121*b*, 122*b*, 123*b*, 124*b*.

Therefore, when the contact point B and the contact point C of each first switching element 121*a*, 122*a*, 123*a* or 124*a* are connected to each other, a source voltage generated by the source voltage generator 110 passes through the first Zener diode ZD1 of the voltage generator 130, such that the developing bias voltage is generated. The generated developing bias voltage is applied to the developing roller of the corresponding developer.

In addition, when the contact point B and the contact point C of each second switching element 121*b*, 122*b*, 123*b* or 124*b* are connected to each other, a source voltage generated by the source voltage generator 110 passes through the second Zener diode ZD2 of the voltage generator 130, such that the developing bias voltage is generated. The generated developing bias voltage is applied to the developing roller of the corresponding developer.

Therefore, the first Zener diode ZD1 and the second Zener diode ZD2 of the voltage generator 130 are located at the front end of the switching unit 120, such that a relatively uniform voltage can be provided to each developer by a deviation of the Zener diode components. As a result, a deviation of voltage between individual developers, caused by a deviation of components of the Zener diode, can be reduced, so that a color image quality can be increased.

Meanwhile, a non-contact type image forming apparatus generally includes a gap between the photoconductive drum 40 and each developing roller 53Y, 53M, 53C or 53K. In contrast, in the case of a contact type image forming apparatus, such as a mono-laser printer, the photoconductive drum 40 contacts each developing roller 53Y, 53M, 53C or 53K.

Therefore, in the non-contact type image forming apparatus, the source voltage generator 110 generates the source voltage identical to the sum of the AC voltage and the DC voltage. In the meantime, in the contact-type image forming apparatus, the source voltage generator 110 does not generate another source voltage composed of only the DC voltage without the source voltage identical to the sum of the AC and DC voltages.

Operations of the non-contact type image forming apparatus will hereinafter be described in detail.

The source voltage generator 110 includes an AC voltage generator 111, a DC voltage generator 112, and an overlapping unit 113. The AC voltage generator 111 generates the AC voltage. The DC voltage generator 112 generates the DC voltage. The overlapping unit 113 receives the AC voltage from the AC voltage generator 111 and the DC voltage from the DC voltage generator 112, such that the overlapping unit 113 outputs a high AC+DC voltage corresponding to the result of overlapping the two voltages.

The deviation of a common voltage caused by a deviation of components of the first Zener diode ZD1 and the second Zener diode ZD2 can be minimized by adjusting either an AC voltage generated by the AC voltage generator 111 or a DC voltage generated by the DC voltage generator 112, when the AC voltage and the DC voltage are overlapped to generate a source voltage.

Figure 5:
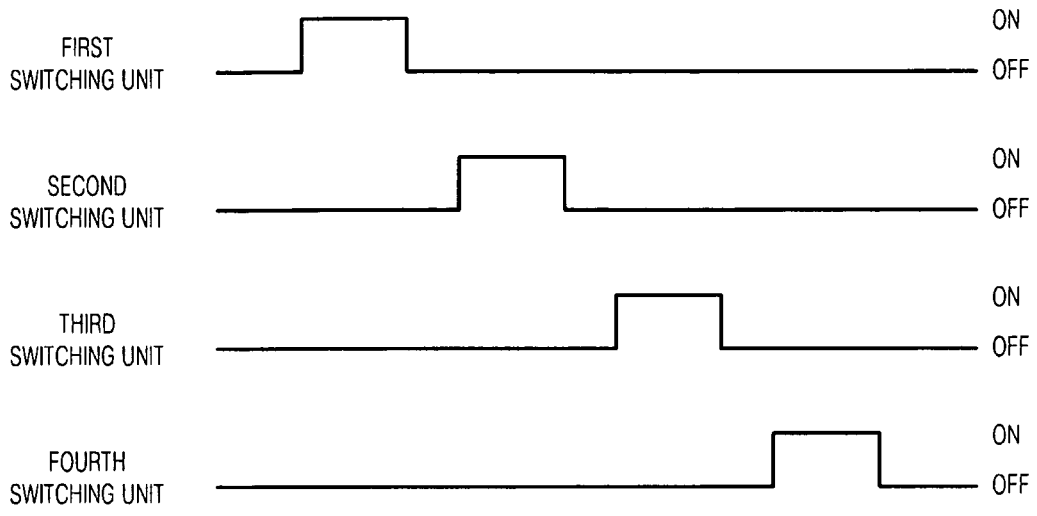
FIG. 5 is a timing diagram illustrating first to fourth switching units shown in FIG. 3 according to at least one embodiment.

Therefore, the source voltage acquired by the overlapping of the AC high-voltage and the DC high-voltage is converted into a voltage suitable for the system while passing through the voltage generator 130, and the developing bias voltage and the supply bias voltage are sequentially applied to the corresponding developer according to the switching operation of the switching unit 120 (see FIG. 5). In this case, the voltage generator 130 composed of two Zener diodes, ZD1 and ZD2, is located between the source voltage generator 110 and the voltage switching unit 120. Although a deviation of the developing voltage occurs due to the deviation of the Zener diodes ZD1 and ZD2, almost the same developing voltage is provided to individual color developers, such that various influences caused by the deviation of Zener diodes ZD1 and ZD2 can be reduced.

In brief, the at least one embodiment discloses that the developing bias end and the supply bias end are separated from each other at the front end of the switching unit 120, and one pair of switching elements are used to output the developing bias and the supply bias, whereas the related art discloses that the developing bias end and the supply bias end are separated from each other at the rear end of the switching unit 120. In other words, according to the related art, the Zener diodes ZD1 and ZD2 are mounted to the rear end of the switching unit between individual colors, so that the voltage applied to individual developers is changed because of the deviation of Zener diode components. In contrast, according to the at least one embodiment, the Zener diodes ZD1 and ZD2 are located at the front end of the switching unit 120, so that the deviation of voltage provided to individual developers can be minimized by the deviation of Zener diode components, resulting in the implementation of a uniform-quality color image.

The Zener diodes ZD1 and ZD2 are arranged at the output end of the source voltage generator 110, so that the deviation caused by the Zener diodes ZD1 and ZD2 can be compensated for when a reference voltage is established using variable resistor components of the source voltage generator 110. As a result, a voltage difference between individual developers can be reduced by the deviation of the Zener diodes ZD1 and ZD2.

Meanwhile, the first contamination prevention unit 141 is connected to a line via which the terminal B, acting as one terminal of each second switching element 121*b*, 122*b*, 123*b* or 124*b* of the switching unit 120, is connected to one side of the second Zener diode ZD2. In order to prevent inter-color contamination in which a toner moves from one developer that is in a developing mode to another developer not performing developing action from among four developers 50Y, 50M, 50C and 50K, at least one resistor of the first contamination prevention unit 141 is grounded in such a manner that the resistor is used as load for a developer having no developing action.

The first contamination prevention unit 141 includes at least one resistor R1, one side thereof which is grounded, and the other side which is connected to the second Zener diode ZD2. In case of the developer having no developing action, a voltage supplying terminal is floated, so that toner developed on the photoconductive drum 40 is reversely transferred to another floated developer and moves to the developing roller of the developer having no developing action. The first contamination prevention unit 141 is a load, so that the contamination problem can be solved.

In addition, a second contamination prevention unit 142 is connected to a line via which the terminal A, acting as the other terminal of each first switching element 121*a*, 122*a*, 123*a* or 124*a*, is connected to the terminal A, acting as the other terminal of each second switching element 121*b*, 122*b*, 123*b* or 124*b*.

In order to prevent inter-color contamination in which a toner moves from one developer performing a developing action to one developer performing no developing action from among four developers 50Y, 50M, 50C and 50K, the second contamination prevention unit 142 applies a DC voltage to the developing bias end of the developer having no developing action and the supply bias end in such a manner that the developing bias end of the developer having no developing action and the supply bias end are floated. In other words, when a second color is developed, the second contamination prevention unit 142 prevents the developing bias end of the developer having no developing action and the supply bias end from being floated, and prevents the occurrence of contamination using a voltage offset.

As is apparent from the above description, a Zener diode separately installed to correspond to each developing device so as to form a difference in potential between the developing bias voltage and the supply bias voltage of each developing device, is installed at a common end, so that a deviation of the developing voltage applied to the developing device affected by a deviation of Zener diode components can be reduced, resulting in an increased color image quality.

In addition, according to one aspect of the at least one embodiment, the Zener diode is installed in a common end, such that the number of Zener diodes is reduced, resulting in a reduction in production costs.

Although at least one embodiment has been shown and described, it would be appreciated by those skilled in the art that changes may be made in the at least one embodiment without departing from the principles and spirit of the invention, the scope of which is defined in the claims and their equivalents.

What is claimed is:

1. An image forming apparatus having a plurality of developing units including a developing roller and a supply roller, the apparatus comprising:

a first, source, voltage generator to generate a source voltage to provide the plurality of developing units with a power-supply voltage;

a second voltage generator to generate a developing bias voltage applied to the developing roller and a supply bias voltage applied to the supply roller upon receiving the source voltage generated by the source voltage generator; and a switching unit to selectively provide the plurality of developing units with different voltage levels generated by the second voltage generator, wherein the switching unit includes a single pair of switching elements in each developing unit, and the single pair of switching elements includes a first switching element connected to a developing bias end of the developing roller and a second switching element connected to a supply bias end of the supply roller.

2. The apparatus according to claim 1, wherein the second voltage generator includes:

a first Zener diode connected in series to an output end of the source voltage generator and a first switching element of the switching unit; and a second Zener diode connected in series to an output end of the source voltage generator and a second switching element of the switching unit, wherein the first Zener diode and the second Zener diode are arranged in opposite directions.

3. The apparatus according to claim 2, wherein the first Zener diode is forward connected, and the second Zener diode is inversely connected.

4. The apparatus according to claim 2, wherein the number of first Zener diodes is 1, and the number of second Zener diodes is 1.

5. The apparatus according to claim 1, wherein the source voltage generator generates a source voltage in which a DC voltage and an AC voltage are overlapped with each other.

6. The apparatus according to claim 5, wherein the source voltage generator generates the source voltage by overlapping the AC voltage, where a deviation of components of the second voltage generator is compensated, with the DC voltage.

7. The apparatus according to claim 5, wherein the source voltage generator generates the source voltage by overlapping the DC voltage, where a deviation of components of the second voltage generator is compensated, with the AC voltage.

8. The apparatus according to claim 1, wherein the source voltage generator generates the source voltage composed of only a DC voltage.

9. An image forming apparatus having a plurality of developing units including a developing roller and a supply roller, the apparatus comprising:

a first, source, voltage generator to generate a source voltage to provide the plurality of developing units with a power-supply voltage;

a second voltage generator to generate a developing bias voltage applied to the developing roller and a supply bias voltage applied to the supply roller upon receiving the source voltage generated by the source voltage generator;

a switching unit to selectively provide the plurality of developing units with different voltage levels generated by the second voltage generator; and first contamination prevention unit including at least one resistor, the at least one resistor being connected to a front end of the switching unit, and the first contamination prevention unit being grounded through the resistor, such that the first contamination prevention unit is operated as a load of the developing unit not performing the developing action, the first contamination prevention unit preventing inter-color contamination by which a toner moves to a specific developing unit not performing a developing action from among the developing units.

10. The apparatus according to claim 9, further comprising:

a second contamination prevention unit which provides a DC voltage to a developing bias end of a specific developing unit not performing the developing action and a supply bias end so as to prevent inter-color contamination by which a toner moves to the specific developing unit not performing developing action from among the developing units.

11. An image forming apparatus, comprising:

a single photoconductive drum;

a light scanning unit to form an electrostatic latent image by scanning a light beam to the photoconductive drum;

a plurality of developing units arranged in a rotation direction of the photoconductive drum so as to provide a toner to the electrostatic latent image formed on the photoconductive drum, the developing units each including a developing roller and a supply roller;

a first, source, voltage generator to generate a source voltage so as to provide a power-supply signal to the developing units;

a second voltage generator to generate a developing bias voltage applied to a developing roller and a supply bias voltage applied to a supply roller upon receiving the source voltage generated by the source voltage generator; and a switching unit to selectively provide the plurality of developing units with different voltage levels generated by the second voltage generator, wherein the switching unit includes a single pair of switching elements in each developing unit, and the single pair of switching elements includes a first switching element connected to a developing bias end of the developing roller and a second switching element connected to a supply bias end of the supply roller.

12. The apparatus according to claim 11, wherein the second voltage generator includes:

a first Zener diode connected in series to an output end of the source voltage generator and a first switching element of the switching unit; and a second Zener diode connected in series to an output end of the source voltage generator and a second switching element of the switching unit, wherein the first Zener diode and the second Zener diode are arranged in opposite directions.

13. The apparatus according to claim 12, wherein the number of first Zener diodes is 1, and the number of second Zener diodes is 1.

14. The apparatus according to claim 11, wherein the source voltage generator generates a source voltage in which a DC voltage and an AC voltage are overlapped with each other or another source voltage composed of only a DC voltage.

15. An image forming apparatus comprising:

a single photoconductive drum;

a light scanning unit to form an electrostatic latent image by scanning a light beam to the photoconductive drum;

a plurality of developing units arranged in a rotation direction of the photoconductive drum so as to provide a toner to the electrostatic latent image formed on the photoconductive drum, the developing units each including a developing roller and a supply roller;

a first, source, voltage generator to generate a source voltage so as to provide a power-supply signal to the developing units;

a second voltage generator to generate a developing bias voltage applied to a developing roller and a supply bias voltage applied to a supply roller upon receiving the source voltage generated by the source voltage generator;

a switching unit to selectively provide the plurality of developing units with different voltage levels generated by the second voltage generator;

a first contamination prevention unit including at least one resistor, the at least one resistor being connected to a front end of the switching unit, the first contamination prevention unit being grounded through the resistor such that the first contamination prevention unit is operated as a load of the developing unit performing no developing action; and a second contamination prevention unit to provide a DC voltage to a developing bias end of the specific developing unit performing no developing action and a supply bias end, wherein the first contamination prevention unit and the second contamination prevention unit prevent intercolor contamination by which a toner moves to a specific developing unit not performing a developing action from among the developing units.

16. An image forming apparatus, comprising:

a plurality of developing units each including a developing roller and a supply roller;

a first, source, voltage generator to generate a source voltage to provide the plurality of developing units with a power-supply voltage;

a second voltage generator to generate a developing bias voltage applied to the developing roller and a supply bias voltage applied to the supply roller upon receiving the source voltage generated by the source voltage generator; and a switching unit to selectively provide the plurality of developing units with different voltage levels, wherein the second voltage generator separates a developing bias end and a supply bias end of each of the developing units at a front end of the switching unit.

17. The apparatus according to claim 16, wherein the second voltage generator includes:

a first Zener diode connected in series to an output end of the source voltage generator and a first switching element of the switching unit; and a second Zener diode connected in series to an output end of the source voltage generator and a second switching element of the switching unit, wherein the first Zener diode and the second Zener diode are arranged in opposite directions.

18. The image forming apparatus according to claim 17, wherein the switching unit includes a plurality of first and second switching elements, and the image forming apparatus further comprises a first contamination prevention unit connected to a line via which a terminal acting as one terminal of each of the second switching elements is connected to one side of the second Zener diode, and a second contamination prevention unit connected to a line via which a terminal acting as a terminal of each of the first switching elements is connected to a terminal acting as another terminal of each of the second switching elements.

* * * * *